US005833787A

United States Patent [19]

Ehret et al.

[11] Patent Number: 5,833,787

[45] Date of Patent: Nov. 10, 1998

[54] PROCESS FOR MAKING A NONWOVEN WEB DERIVED FROM LACTIC ACID, WEB PRODUCED THEREBY, AND APPARATUS THEREFOR

[75] Inventors: Philippe Ehret, Fortschwihr; Philippe Guipouy, Guebwiller; Kimmo Lahtenkorva, Kayersberg, all of France

[73] Assignee: Fiberweb Sodoca Sarl, Biesheim, France

[21] Appl. No.: 542,168

[22] Filed: Oct. 12, 1995

[30] Foreign Application Priority Data

Oct. 12, 1994 [FR] France ..... 94 12332

[51] Int. Cl.[6] ..... D04H 1/42; D04H 3/16

[52] U.S. Cl. ..... 156/167; 156/229; 264/210.8; 264/290.2; 264/290.5

[58] Field of Search ..... 264/290.2, 210.5, 264/210.8, 290.5; 156/164, 167, 229

[56] References Cited

U.S. PATENT DOCUMENTS 3,949,128 4/1976 Ostermeier .
4,160,799 7/1979 Locey et al. .
5,232,533 8/1993 Tani et al. ..... 156/177 X

FOREIGN PATENT DOCUMENTS 0514137 11/1992 European Pat. Off. .
0569154 11/1993 European Pat. Off. .
0637641 2/1995 European Pat. Off. .
2709500 3/1995 France .
5134425 6/1993 Japan .
1213441 11/1970 United Kingdom .

*Primary Examiner*—Michael W. Ball
*Assistant Examiner*—Sam Chuan Yao
*Attorney, Agent, or Firm*—Weiser and Associates P.C.

[57] ABSTRACT

The invention relates to a process for the manufacture of a nonwoven web using filaments of melted polymers, of the type including the steps of spinning the polymer or polymers, of cooling, drawing and laying down fibers on a belt and of bonding said fibers by calendering in order to form said nonwoven web (15), which process furthermore includes a treatment (13, 14) of setting/adjusting the degree of crystallinity of and the internal tension in the fibers making up the nonwoven web. The invention also relates to the nonwovens obtained by the process and to the installations for implementing it.

11 Claims, 1 Drawing Sheet

PROCESS FOR MAKING A NONWOVEN WEB DERIVED FROM LACTIC ACID, WEB PRODUCED THEREBY, AND APPARATUS THEREFOR

The invention relates to a process for manufacturing a nonwoven web based on polylactides.

BACKGROUND OF THE INVENTION

Nonwovens are often manufactured by a manufacturing process called spin bonding (SB) using fibers of nonbiodegradable polymers since the use of biodegradable compounds, such as lactic acids, leads to nonwovens whose stability and mechanical properties are currently difficult to control.

Today, throughout the world, sites for discharging solid waste are becoming rapidly saturated. This waste comprises a large amount of nonwoven products from diapers (for babies and adults), products for feminine hygiene (sanitary napkins), disposable protective clothing, nonwoven products used in agriculture and many other products.

Recently there has been a tendency to promote a reduction in the flow of waste to discharge sites by opting for composting. However, all the nonwoven products mentioned above are conventionally manufactured from polyolefins, PE (polyethylene), PP (polypropylene), and from their blends or from other polymers which do not allow composting. The solution lies in producing biodegradable polymers, the degradation of which is carried out by the municipalities in their solid-waste composting systems.

Several biodegradable polymers exist on the market, for example copolymers based on polyhydroxybutyrate/valerate (PHB/V). (Zeneca Bio Products: BIOPOL), polycaprolactones (PCL), (Union Carbide: TONE, Interox Chemicals: CAPA), several polymers based on starch or starch derivatives, (Warner-Lambert: NOVON), polymers based on polyglycolic acid (PGA), polymers based on polylactides (PLA), (Boehringer Ingelheim: RESOMER) and other biodegradable polyesters.

The subject matter of European Patent Application No. 93303009.9 of Apr. 19, 1993, the inventor of which is Showa Shenko K. K., is biodegradable aliphatic polyesters used as a material for disposable diapers (also nonwoven parts).

Polylactide (called PLA) or its derivatives (L and D type or copolymers) is potentially one of the most degradable polymers because it has good mechanical properties, it is totally degradable, the degradable products are natural materials, the degradation time can be varied, the raw material comes from renewable sources such as beet sugar or whey and it can be incinerated with no problem. It may be extruded in the form of a film (European Patent Application No. 92304269.1 of May 12, 1992, Mitsui Toatsu Chemicals, Inc.) or in the form of a bulk product and it may be injection molded. Adding a heat stabilizer allows it to be recycled and, finally, it may be melted and extruded, and consequently it is suitable for producing nonwovens intended for hygiene applications, as is described in French Patent 9309649, of Aug. 2, 1993, and European Patent 944700186, FIBERWEB SODOCA and Japanese Patent Application 134425 of Jun. 4, 1993, MITSUI TOASTU CHEMICALS Inc.

The properties of polymers derived from polylactides vary depending on the type of polymer (L or D type), on the residual amount of monomer (lactide) and, in the case of DL copolymers, on the ratio of D units to L units.

The process most often used to manufacture nonwovens is the process called "spin bonding", abbreviated to SB hereafter. In this process, the polymer is melted and extruded by means of a single-screw or twin-screw extruder and then conveyed to the spinning pump or pumps which are usually gear pumps. Frequently, a filter and a static mixer are placed before the pumps.

On leaving the pumps, the stream of molten polymer is conveyed through the filter to the spinneret, which contains a series of small holes (0.2 to 2.0 mm in diameter), usually of the order of several thousands. The polymer is spun through the spinneret and conveyed to the cooling and drawings sections. Cooling may be by forced chilled air and the drawing is achieved by suction of air or air forced through the drawing section.

The drawing section may consist of a wide slit or several smaller slits or nozzles. In the drawing section, the fibers have a decreasing diameter and adopt an oriented structure. The draw ratio is generally 1.1 to 20 x. In the SB process, the linear density of the fibers is of the order of 0.5 to 20 dtex.

The spinning section is followed by a laydown section where the fibers are laid down randomly on a belt. The belt conveys the fibers to the calendar. The weight/$m^2$ may be adjusted by varying the speed of the belt.

FIG. 1 shows diagrammatically an installation for implementing a known SB process (for example the S-Tox process) consisting mainly of: (1) a hopper, (2) an extruder, (2') a screw, (3') a spinneret, (4) a belt, (5) a bonding calender, (6) a means for guiding the web and adjusting the wind-up tension, (7) a winding means, (9) a unit for cooling the fibers, (11) a drawing nozzle and (11') drawing suction.

The spinning in the SB process generates fibers of PLA having a highly oriented structure (high degree of drawing and rapid cooling).

This means that the amorphous phase is well oriented and has a high internal tension, and that the fibers have a tendency to shrink when using temperatures above the $T_g$ (glass transition temperature), (Ahamad Y. A. Khan et al., "Melt processing of poly(lactide) resin into nonwovens", TANDEC, University of Tennessee).

The crystallinity and the state of the amorphous phase have a considerable effect on the properties of the web. If the crystallinity is too high, the web becomes brittle and if the amorphous phase is under internal tension (a high degree of orientation), it will shrink at high temperatures.

Conventional bonding processes (for example calendering between a smooth roll and a heated etched roll, with external control of the pressure, so that the bonded surface area is from 7 to 25%) at temperatures between 70° C. and 100° C. (depending on the grade and the type of polymer) cannot be carried out because of the shrinkage, and, at lower temperatures, the bonding is not optimal. In addition, if satisfactory bonding is achieved at a low temperature, the product is found to have stability problems. In a very humid atmosphere, the web shrinks at a temperature below 40° C.

PLA has a tendency to stick at temperatures of between 70° and 100° C. It is difficult to remove PLA laid down on the calendering rolls when this sticking is combined with simultaneous shrinkage. Calendering at high temperatures (>100° C.) increases the crystallinity considerably (very slow cooling), which leads to a lower elongation.

SUMMARY OF THE PREFERRED BODY OF THE INVENTION

The main object of the invention is to provide a process for the manufacture of a spun-bonded nonwoven (called an SB) based on polylactides, which is biodegradable and which has characteristics identical to those of conventional nonwovens based on polyolefins.

More particularly, the process according to the invention is intended to improve the mechanical properties of the polylactide-based nonwoven and to stabilize it in order to prevent shrinkage caused by high temperatures.

For this purpose, the process according to the invention makes it possible to set or adjust the degree of crystallinity and the internal tension of the fiber making up the web of PLA-based nonwoven.

A process according to the invention applies to the manufacture, by spin bonding, of a nonwoven exclusively composed of one or more polymers derived from lactic acid, such as polylactides, that is to say all the filaments of which it is composed are made entirely of a polymer derived from lactic acid, or of a blend of polymers derived from lactic acid or of a copolymer derived from lactic acid.

Preferably, the polymer derives from an L- or D-lactic acid.

Preferably, the blend of polymers is a blend of polymers derived from L-acid and derived from D-acid.

Preferably, the filaments of the nonwoven are derived from L- and D-lactic acids (copolymers).

More particularly, a process according to the invention includes a treatment of setting/adjusting the degree of crystallinity of and the internal tension in the fibers making up the nonwoven web.

According to a first variant, the setting/adjusting treatment consists of biaxial setting after the calendering, and then low-temperature heating followed by cooling, it being possible for said heating to be performed by any suitable means, for example in an oven or by infrared radiation.

According to a second variant, the setting/adjusting treatment consists of rapid cooling immediately after high-temperature calendering.

BRIEF DESCRIPTION OF THE DRAWINGS

The invention will be better understood with the aid of the following description, given with reference to the following appended figures.

DETAILED DESCRIPTION OF THE PREFERRED BODY OF THE INVENTION

The novelty of the process according to the invention is that it includes at least one treatment for setting or adjusting the degree of crystallinity of and the internal tension in the fibers making up the PLA-based nonwoven web.

Figure 1:
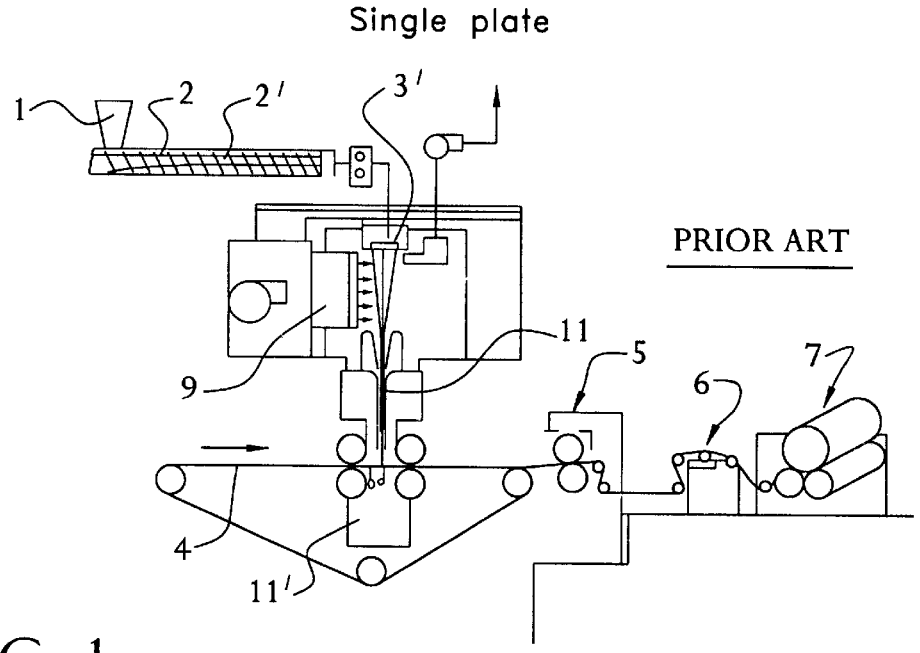
FIG. 1: a diagram of an installation for implementing a spin-bonding or SB process of the prior art.
Figure 2:
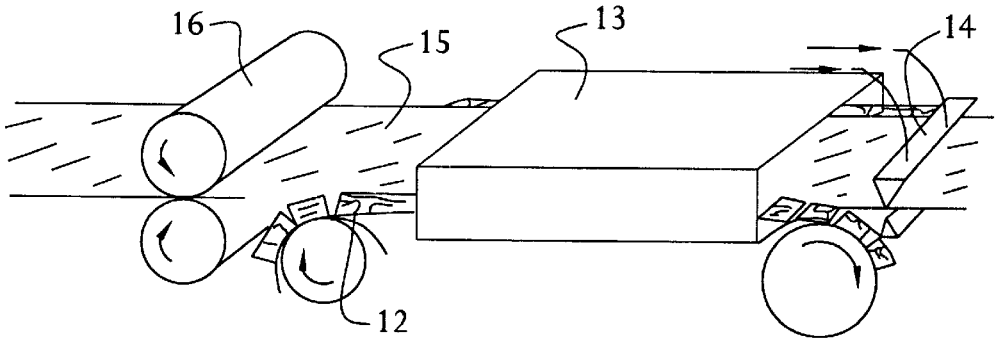
FIG. 2: a diagram of a setting/adjusting treatment assembly according to the invention, which can be combined with an installation as shown in FIG. 1.
Figure 3:
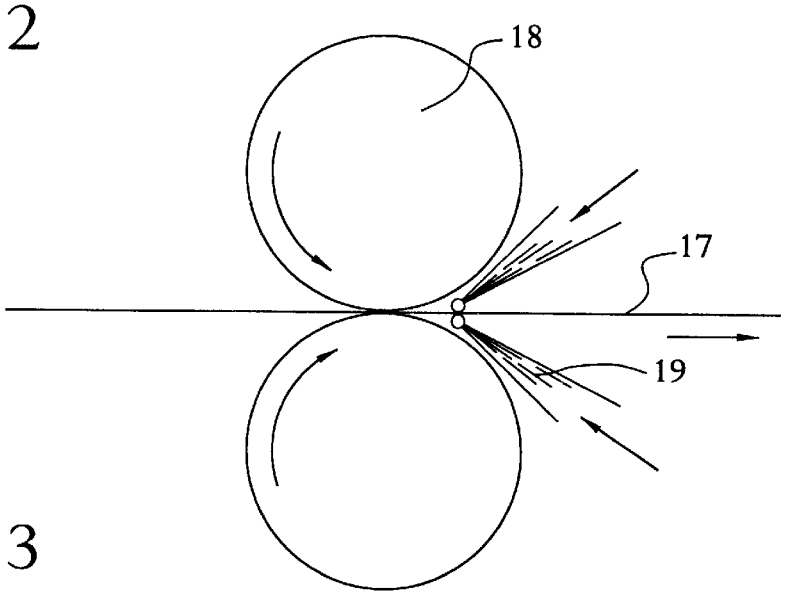
FIG. 3: a diagram of another setting/adjusting treatment assembly according to the invention, which can be combined with an installation as shown in FIG. 1.

This setting/adjusting step may be carried out in the following two ways (which are not limiting):

1) After calendering in a calender (16) and setting at (12) at low temperature (see FIG. 2), the bonded web (15) (having biaxial tension) is subjected to a temperature control in heating means (13) and then cooled in cooling means (14).

If the calendering is performed at low temperature (70° C.) and at a reasonably high pressure, the bonding is satisfactory, but the level of elongations and strengths is low and the web has a tendency to shrink later when subjected to higher temperatures.

In order to eliminate this tendency and to improve the mechanical properties, the web is set biaxially after calendering and heated in an oven for 10 to 60 seconds at a temperature varying from 80° C. to 150° C., or heated for a few seconds (0.5 to 10 s) by an IR generator at a temperature varying from 80° C. to 150° C. These treatments may be performed in-line or as a post-treatment.

The temperature control according to one or other of the heating (13) variants has the effect of relaxing the internal tension and increasing the degree of crystallinity. As a result, a higher elongation and a higher strength are found and the web no longer shrinks.

The heating time and the temperature must be chosen precisely in order to prevent embrittlement of the web as a result of too high a temperature.

2) A web (17) is bonded at a high calendering temperature in a calender (18) and immediately rapidly cooled by cooling means (19).

Good mechanical properties, no sticking to the calender and a web having properties which are stable at high temperatures may be obtained by using very high calendering temperatures (from 100° to 150° C.) and by cooling the web immediately after calendering by blowing air onto it. This treatment produces very satisfactory bonding and a degree of crystallinity which is not too high. The web has an elongation and a satisfactory strength, and is stable at high temperatures. The ideal temperature depends on the weight/$m^2$ of the nonwoven, on the type of polymer, on the line speed and on the properties required.

Elongations 10 times higher and a strength twice as high as the usual values are obtained using this method.

PREFERRED EXAMPLES

The invention will be illustrated by the following non-limiting examples:

The nonwoven webs used in theses examples are manufactured under the following conditions:

| | |
|---|---|
| Process: | S-Tex |
| Raw material: | PLLA |
| Average molecular weight: | 130,000–140,000 |
| Polydispersity: | 1.9 |
| Melting point: | 160–165° C. |
| Extrusion temperature: | 190° C.–210° C. |
| Spinning | |
| chilled air: | 0.3–1.0 m/s, 10–20° C. |
| drawing: | 30–90 mm/Ce |
| Belt speed: | 15–30 m/s |
| Calendar temperature: | 50–70° C. (as high as possible without causing the web to shrink) |

EXAMPLE 1

| Nonwoven web | |
|---|---|
| Initial values | |
| Weight/$m^2$: | 25 g/$m^2$ |
| Denier: | 2.5 dtex |
| MD strength: | 20 N/5 cm |
| MD elongation: | 5% |

-continued

| Nonwoven web | |
|---|---|
| Heat treatment | |
| Method: | Biaxiality set and heated oven |
| Temperature: | 100° C. |
| Duration: | 2 min |
| Improvement in the properties (%) | |
| MD strength: | 100% |
| MD elongation: | 1000% (10 fold) |
| Shrinkage at 100° C. without setting: | Nonexistent |

EXAMPLE 2

| Nonwoven web | |
|---|---|
| Initial values | |
| Weight/m$^{2:}$ | 65 g/m$^2$ |
| Denier: | 2.5 dtex |
| MD strength: | 80 N/5 cm |
| MD elongation: | 26% |
| Heat treatment | |
| Method: | Biaxiality set and heated oven |
| Temperature: | 100° C. |
| Duration: | 2 min |
| Improvement in the properties (%) | |
| MD strength: | 20% |
| MD elongation: | 400% |
| Shrinkage at 100° C. without setting: | Nonexistent |

EXAMPLE 3

| Nonwoven web | |
|---|---|
| Initial values | |
| Weight/m$^{2:}$ | 26 g/m$^2$ |
| Denier: | 1.8 dtex |
| MD strength: | 27 N/5 cm |
| MD elongation: | 10% |
| Heat treatment | |
| Method: | Biaxiality set and heated on the S-Tex line with an IR heater |
| Temperature: | approximately 120° C. (maximum) power, 9 kW) |
| Duration: | 2 s |
| Improvement in the properties (%) | |
| MD strength: | 40% |
| MD elongation: | 400% (4 fold) |
| Shrinkage at 100° C. without setting: | 4–6% |

EXAMPLE 4

In this example, the same process parameters are used, except that the calendering temperature is higher, from 120° to 150° C., and cooling occurs immediately after calendering, which reduce the temperature of the web to 20°–60° C. Efficient cooling after calendering prevents the web from shrinking.

| Nonwoven web | |
|---|---|
| Initial values | |
| Weight/m$^{2:}$ | 60 g/m$^2$ |
| Denier: | 2.5 dtex |
| MD strength: | 65 N/5 cm |
| MD elongation: | 30% |
| Heat treatment | |
| Method: | Hot calendaring and immediate cooling with blown air at a temperature of 15–30° C. |
| Temperature: | 120–150° C. |
| Improvement in the properties (%) (if calendering is carried out at the temperatures mentioned in Examples 1 to 3). | |
| MD strength: | 40% |
| MD elongation: | 50% |
| Shrinkage at 100° C. without setting: | 5–10% |

In order to implement the process according to the invention, an apparatus is set up for manufacturing a non-woven web using polymers, of the type including means of spinning the polymer or polymers, of cooling, drawing and laying down fibers on a belt and of bonding said fibers by calendering in order to form a web (15, 17), which process furthermore includes means for setting/adjusting the degree of crystallinity of and the internal tension in fibers making up the web (15, 17).

More particularly, the setting/adjusting treatment means consist of biaxial-setting means (15) and of heating means (13) taken from the group: oven, infrared radiation, or consist of rapid cooling means (19) located just after calendering means (18) heated to high temperature.

We claim:

1. A process for the manufacture of a nonwoven web using fibers of one or more melted polymers, consisting of lactic acid or a derivative thereof, and wherein the process comprises the steps of spinning the melted polymer to form the fibers, cooling, drawing and laying down the fibers on a belt, bonding said fibers by calendaring to form the web, and setting/adjusting the degree of crystallinity of and the internal tension in the fibers of the nonwoven web, the setting/adjusting consisting essentially of biaxial setting after the calendaring, then low temperature heating the web under biaxial tension, followed by cooling.

2. The process of claim 1, wherein the heating is oven heating for 10 to 60 s at a temperature varying from 80° C. to 150° C.

3. The process of claim 1, wherein the heating is heating for a few seconds by infrared radiation at a temperature varying from 80° C. to 150° C.

4. The process of claim 1 wherein the polymer is a polymer of L-lactic acid or D-lactic acid.

5. The process of claim 4 wherein the polymer is a polymer of L-lactic acid and D-lactic acid.

6. The process of claim 1 wherein the degree of crystallinity is increased.

7. The process of claim 1 wherein the internal tension in the fibers is relaxed.

8. The process of claim 1 wherein the degree of crystallinity is increased and the internal tension in the fibers is relaxed.

9. An apparatus for implementing the process of claim 1 for the manufacture of a non-woven web using polymers, of the type including means of spinning the polymer or polymers, of cooling, drawing and laying down fibers on a belt and of bonding said fibers by calendaring in order to form a web, which apparatus furthermore includes treatment means for setting/adjusting the degree of crystallinity of and the internal tension in fibers making up the web, wherein the setting/adjusting treatment means comprises means for biaxial-setting the web and means for low-temperature heating of the web under biaxial tension.

10. The apparatus of claim 9, wherein the setting/adjusting treatment means consist of biaxial-setting means and of heating means selected from the group: oven, and infrared radiation.

11. The apparatus of claim 9, wherein the setting/adjusting treatment means further comprises cooling means for cooling the web following the means for low temperature heating.

* * * * *